US009905911B2

(12) United States Patent
Chen et al.

(10) Patent No.: US 9,905,911 B2
(45) Date of Patent: Feb. 27, 2018

(54) ANTENNA FOR ELECTRONIC DEVICE

(71) Applicant: HON HAI PRECISION INDUSTRY CO., LTD., New Taipei (TW)

(72) Inventors: Wei-Yu Chen, New Taipei (TW); Yueh-Chu Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 193 days.

(21) Appl. No.: 14/920,613

(22) Filed: Oct. 22, 2015

(65) Prior Publication Data

US 2017/0062930 A1 Mar. 2, 2017

(30) Foreign Application Priority Data

Aug. 31, 2015 (CN) ..... 2015 1 0546222

(51) Int. Cl.
*H01Q 9/42* (2006.01)
*H01Q 1/24* (2006.01)
*H01Q 5/35* (2015.01)

(52) U.S. Cl.
CPC ..... *H01Q 1/243* (2013.01); *H01Q 5/35* (2015.01); *H01Q 9/42* (2013.01)

(58) Field of Classification Search
CPC ..... H01Q 1/243; H01Q 5/35; H01Q 9/42
USPC ..... 343/845
See application file for complete search history.

(56) References Cited

U.S. PATENT DOCUMENTS

2012/0119955 A1* 5/2012 Milosavljevic ..... H01Q 1/243 343/702
2016/0197407 A1* 7/2016 Tanaka ..... H01Q 1/243 343/845

* cited by examiner

*Primary Examiner* — Andrea Lindgren Baltzell
(74) *Attorney, Agent, or Firm* — ScienBiziP, P.C.

(57) ABSTRACT

An electronic device includes a control module, a first antenna frame, and a second antenna frame. A first ground point, a first feed point, and a second ground point are respectively located on the first antenna frame. A second feed point, a third ground point, and a third feed point are respectively located on the second antenna frame. A switching unit and a low-pass circuit being electrically coupled between one end portion of the first antenna frame and one end portion of the second antenna frame, wherein the switching unit is controlled by the control module to selectively connect the first antenna frame and the second antenna frame. If the switching unit is closed, an antenna element formed between the first ground point and the third feed point is enabled, and the antenna element is operated to receive and/or transmit low frequency signal.

13 Claims, 1 Drawing Sheet

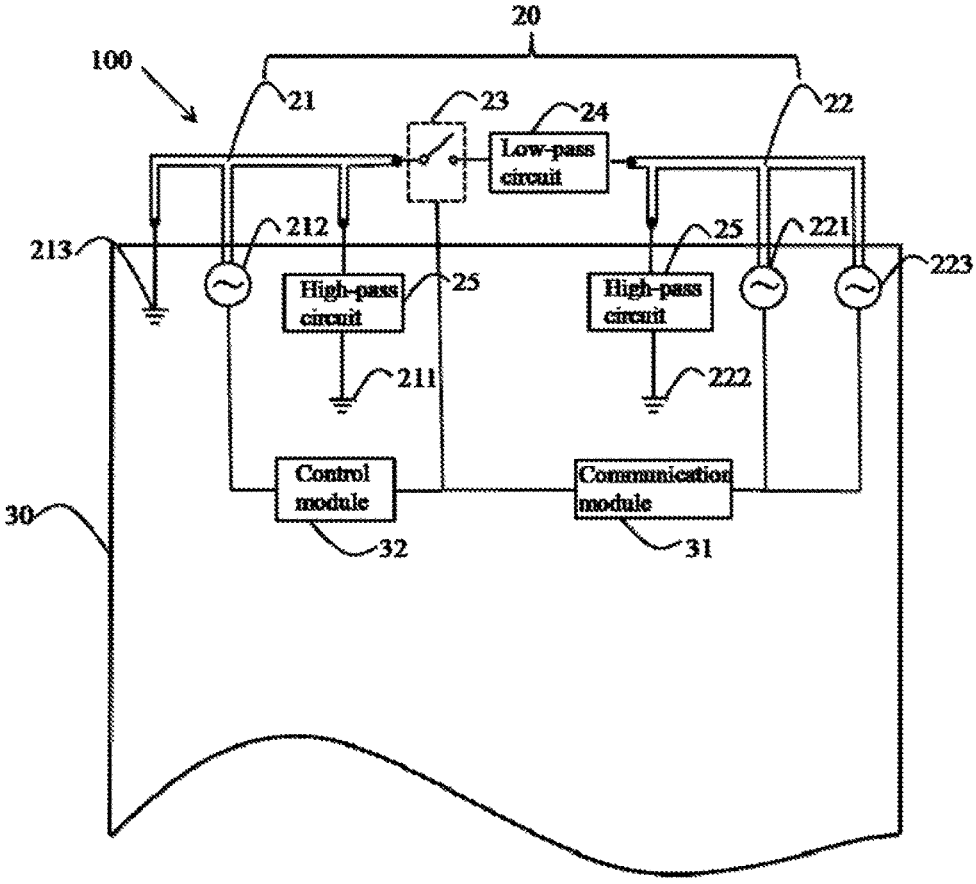
20
100
21
23
24
22
Low-pass circuit
212
25
221
213
223
High-pass circuit
25
High-pass circuit
211
222
Control module
Communication module
30
32
31

ANTENNA FOR ELECTRONIC DEVICE

CROSS-REFERENCE TO RELATED APPLICATIONS

This application claims priority to Chinese Patent Application No. 201510546222.8 filed on Aug. 31, 2015, the contents of which are incorporated by reference herein.

FIELD

The subject matter herein generally relates to wireless communication technology, and particularly to an electronic device having an antenna.

BACKGROUND

Existing electronic devices are equipped with multiple antennas for radiating different signal types. However, multiple antennas occupy a large area of the electronic device.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

The FIGURE is a block diagram of an embodiment of an antenna for an electronic device.

DETAILED DESCRIPTION

It will be appreciated that for simplicity and clarity of illustration, where appropriate, reference numerals have been repeated among the different FIGURES to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts can be exaggerated to better illustrate details and features. The present disclosure, including the accompanying drawings, is illustrated by way of examples and not by way of limitation.

Several definitions that apply throughout this disclosure will now be presented.

It should be noted that references to "a/an" or "one" embodiment in this disclosure are not necessarily to the same embodiment, and such references mean "at least one." Furthermore, the term "comprising" means "including, but not necessarily limited to"; it specifically indicates open-ended inclusion or membership in a so-described combination, group, series and the like. The term "coupled" is defined as connected, whether directly or indirectly through intervening components, and is not necessarily limited to physical connections. The connection can be such that the objects are permanently connected or releasably connected.

The FIGURE is a block diagram of an embodiment of an antenna 20 employed in an electronic device 100. The electronic device 100 can be a mobile phone, a tablet, or any other suitable electronic devices with communication functions. The electronic device 100 further includes a circuit board 30 for mounting the antenna 20.

In at least one embodiment, the antenna 20 can include, but is not limited to, a first antenna frame 21, a second antenna frame 22, a switching unit 23, and a low-pass circuit 24. In at least one embodiment, the first antenna frame 21 and the second antenna frame 22 have two end portions. In one embodiment, a first ground point 211 and a first feed point 212 are respectively located between the two end portions of the first antenna frame 21. A second ground point 213 is located at one end portion of the first antenna frame 21 which is away from the switching unit 23, and the switching unit 23 is located at the other end portion of the first antenna frame 21. The first ground point 211 is grounded via a high-pass circuit 25. The first feed point 212 can be configured to receive and/or transmit high-frequency signal, for example, the high-frequency signal can be 2G/3G/4G signals. The 2G signal is Global System for Mobile Communication (GSM) signal, the 3G signal is Universal Mobile Telecommunication System (UMTS) signal, and the 4G signal is Long Term Evolution (LTE) signal.

In at least one embodiment, a second feed point 221 and a third ground point 222 are respectively located between the two end portions of the second antenna frame 22, a third feed point 223 is located at one end portion of the second antenna frame 22 which is away from the switching unit 23, and the low-pass circuit 24 is located at the other end portion of the second antenna frame 22. The third ground point 222 is grounded via a high-pass circuit 25. The second feed point 221 can be configured to receive and/or transmit the high-frequency signal, and the third feed point 223 can be configured to receive and/or transmit low-frequency signal, for example, the low-frequency signal can be Near Field Communication (NFC) signal, or Wireless Power Transmission (WPT) signal.

In at least one embodiment, the low-pass circuit 24 can be electrically connected to the other end portion of the first antenna frame 21, and the switching unit 23 can be electrically connected to the other end of the second antenna frame 22.

In at least one embodiment, the second ground point 213 can be coupled to an arbitrary location between the two end portions of the first antenna frame 21, and the third feed point 223 can be coupled to an arbitrary location between the two end portions of the second antenna frame 22.

In at least one embodiment, the low-pass circuit 24 can pass signals with a frequency lower than a certain cutoff frequency and attenuate signals with frequencies higher than the certain cutoff frequency. The high-pass circuit 25 can pass signals with a frequency higher than a certain cutoff frequency and attenuate signals with frequencies lower than the certain cutoff frequency.

In at least one embodiment, the switching unit 23 can be electrically connected between the first antenna frame 21 and the low-pass circuit 24, and the switching unit 23 can control an electrical connection between the first antenna frame 21 and the second antenna frame 22 to be switched on or off. The electrical connection between the first antenna frame 21 and the second antenna frame 22 is in a conducting state when the switching unit 23 is closed. The electrical connection between the first antenna frame 21 and the second antenna frame 22 is in a non-conducting state when the switching unit 23 is open. In at least one embodiment, the switching unit 23 can be a one-pole switch.

In at least one embodiment, the antenna 20 can receive and/or transmit high frequency signal and low frequency signal. When the electrical connection between the first antenna frame 21 and the second antenna frame 22 is in a conducting state, the low-pass circuit 24 can attenuate signals with frequencies higher than the certain cutoff frequency, and the high-pass circuit 25 can attenuate signals with frequencies lower than the certain cutoff frequency to the ground. Thus, the antenna length between the first ground point 211 and the third feeder point 223 can be motivated to receive and/or transmit low frequency signal. The length of the antenna to receive and/or transmit low frequency signal is increased.

In at least one embodiment, the circuit board 30 can include a communication module 31 and a control module 32. The communication module 31 can detect a signal type that is received and/or transmitted by the antenna 20, and send the signal type to the control module 32.

In at least one embodiment, the control module 32 is electrically connected to the switching unit 23 and the first feed point 212, the communication module 31 is electrically coupled between the control module 32 and the second feed point 221, and the communication module 31 is electrically coupled to the third feed point 223. The control module 32 can send a command to control the switching unit 23 to close or open after receiving the signal type. For example, if the communication module 31 detects the signal type is low-frequency signal, the control module 32 can send the command to control the switching unit 23 to close. If the communication module 31 detects the signal type is high-frequency signal, the control module 32 can send the command to control the switching unit 23 to open.

It should be emphasized that the above-described embodiments of the present disclosure, including any particular embodiments, are merely possible examples of implementations, set forth for a clear understanding of the principles of the disclosure. Many variations and modifications can be made to the above-described embodiment(s) of the disclosure without departing substantially from the spirit and principles of the disclosure. All such modifications and variations are intended to be included herein within the scope of this disclosure and protected by the following claims.

What is claimed is:

1. An antenna comprising:

a first antenna frame having two end portions;

a first ground point, a first feed point, and a second ground point each located on the first antenna frame;

a second antenna frame having two end portions;

a second feed point, a third ground point, and a third feed point each located on the second antenna frame; and a switching unit and a low-pass circuit being electrically coupled between one end portion of the first antenna frame and one end portion of the second antenna frame, wherein the switching unit is configured to selectively connect the first antenna frame and the second antenna frame.

2. The antenna as described in claim 1, wherein the first ground point and the first feed point are respectively located between the two end portions of the first antenna frame, and the second ground point is located at one end portion of the first antenna frame which is away from the switching unit.

3. The antenna as described in claim 1, wherein the second feed point and the third ground point are respectively located between the two end portions of the second antenna frame, and the third feed point is located at one end portion of the second antenna frame which is away from the switching unit.

4. The antenna as described in claim 1, wherein the first ground point is grounded via a first high-pass circuit, the third ground point is grounded via a second high-pass circuit.

5. The antenna as described in claim 1, wherein an antenna element formed between the first ground point and the third feed point is enabled if the switching unit is closed and is operated to receive and/or transmit low frequency signal.

6. The antenna as described in claim 1, wherein the first feed point and the second feed point are configured to receive and/or transmit high frequency signals, the third feed point is configured to receive and/or transmit low frequency signals.

7. An electronic device comprising:

a control module;

a first antenna frame having two end portions;

a first ground point, a first feed point, and a second ground point each located on the first antenna frame;

a second antenna frame having two end portions;

a second feed point, a third ground point, and a third feed point each located on the second antenna frame; and a switching unit and a low-pass circuit being electrically coupled between one end portion of the first antenna frame and one end portion of the second antenna frame, wherein the switching unit is controlled by the control module to selectively connect the first antenna frame and the second antenna frame.

8. The electronic device as described in claim 7, wherein the first ground point and the first feed point are respectively located between the two end portions of the first antenna frame, and the second ground point is located at one end portion of the first antenna frame which is away from the switching unit.

9. The electronic device as described in claim 7, further comprising a communication module electrically coupled between the control module and the second feed point, wherein the communication module is electrically coupled to the third feed point.

10. The electronic device as described in claim 9, wherein the control module is configured to close the switching unit if the communication module detects a signal type is low frequency signal, and open the switching unit if the communication module detects the signal type is high frequency signal.

11. The electronic device as described in claim 10, wherein an antenna element formed between the first ground point and the third feed point is enabled if the switching unit is closed and is operated to receive and/or transmit low frequency signal.

12. The electronic device as described in claim 10, wherein the first feed point and the second feed point are configured to receive and/or transmit high frequency signals, the third feed point is configured to receive and/or transmit low frequency signals.

13. A controlling method comprising:

receiving and/or transmitting signals by an antenna of an electronic device;

detecting a signal type of the signals by a communication module of the electronic device;

closing a switching unit of the electronic device if the communication module detects the signal type is low frequency signal; and opening the switching unit of the electronic device if the communication module detects the signal type is high frequency signal.

* * * * *